United States Patent [19]

Gray

[11] 4,336,901

[45] Jun. 29, 1982

[54] INJECTION ASSEMBLY

[76] Inventor: Benjamin C. Gray, Box 1768, Brooks, Alberta, Canada, T0J 0J0

[21] Appl. No.: 133,022

[22] Filed: Mar. 24, 1980

[30] Foreign Application Priority Data

Apr. 10, 1979 [CA] Canada ..... 325415

[51] Int. Cl.[3] ..... B65H 17/34

[52] U.S. Cl. ..... 226/173

[58] Field of Search ..... 226/173, 170, 171, 172

[56] References Cited

U.S. PATENT DOCUMENTS

| | | | |
|---|---|---|---|
| 1,898,014 | 2/1933 | Krumholz | 226/173 X |
| 3,022,928 | 2/1962 | Ulmitz | 226/173 X |
| 3,182,877 | 5/1965 | Stator | 226/172 |
| 3,285,485 | 11/1966 | Stator | 226/173 X |

FOREIGN PATENT DOCUMENTS

| | | | |
|---|---|---|---|
| 890228 | 1/1972 | Canada | 226/173 |
| 953644 | 8/1974 | Canada | 226/173 |
| 963839 | 3/1975 | Canada | 226/173 |

*Primary Examiner*—Edward J. McCarthy
*Attorney, Agent, or Firm*—Stanley G. Ade

[57] ABSTRACT

A split-type injector for flexible drill tubing includes a pressure cylinder connected to linkage which maintains an adjustable pressure of the injection dies upon the tubing passing therethrough. The individual dies on the endless chain are constructed to grip components and tubing of different diameters which passes therethrough and also by means of a relief valve in the pressure system, to widen and close up as different diameter components or tubing pass therethrough. For example if a component such as a coupling is encountered, the halves of the injector move apart to allow it to pass yet at the same time maintain a similar contact upon the coupling and also to maintain similar pressure upon the coupling. When the component has passed, the halves close up and maintain the same pressure and substantial contact area upon the tubing as before.

13 Claims, 4 Drawing Figures

INJECTION ASSEMBLY

BACKGROUND OF THE INVENTION

This invention relates to new and useful improvements in tubing injectors, particularly tubing injectors adapted to be used with long coiled metal tubing for injection and retraction down a well bore.

Heretofore, tubing injectors suffer from two principal disadvantages. Firstly it is difficult to maintain and to adjust the pressure of the drive chains upon the tubing as it is inserted and withdrawn, it being understood that the necessary pressure changes not only with bore hole conditions but also with the length of tubing extending below the injector.

Secondly, conventional tubing injectors include dies attached to the drive chains which are of a single diameter so that they are only suited for use with one diameter of tubing. This means that if a different diameter of tubing is used, then the dies have to be changed.

Furthermore, couplings and other components are often present along the length of the drill tubing and it is difficult to accommodate these couplings and other components, as they pass through the injector because of the different diameters of these couplings and/or components.

SUMMARY OF THE INVENTION

The present invention overcomes these disadvantages by providing a tubing injector which consists of two independently floating halves mounted on a common framework and means to apply pressure of the halves against the tubing passing therethrough. Furthermore, means are provided to permit the halves to move apart and to come together as different diameters are encountered.

One aspect of the invention consists of a tubing injector for well drilling and the like comprising in combination supporting structure, an opposed pair of injector halves supported in said supporting structure, an endless drive chain assembly for each half including tube gripping runs of said chain assemblies in substantially spaced apart relationship, said runs of chain assemblies engaging the tubing therebetween, means to drive said chain assemblies, means mounting said injector halves upon said supporting framework for independent floating movement towards and away from one another, and adjustable pressure means in said framework to urge said halves towards one another whereby said runs of chain grip said tubing frictionally.

A further aspect of the invention is to provide a tube gripping die which is adapted to accommodate tubing or components of different diameters, said die including an attaching face and a tube gripping face, and a slide block die for use with a tubing injector, said slide block die including an attaching side and a tube gripping side, said tube gripping side including a centrally recessed curved segment, a first pair of curved segments one upon each side of said centrally curved segment, and a further pair of portions one upon each side of said first pair of curved segments, the radius of curvature of said first pair of curved segments being greater than the radius of curvature of said central curved segment.

Another aspect of the invention is to provide a device of the character herewithin described in which the pressure can be adjusted and maintained upon the tubing and upon any couplings or components or tubing lengths of different diameter that may pass therethrough.

A further aspect of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 2:
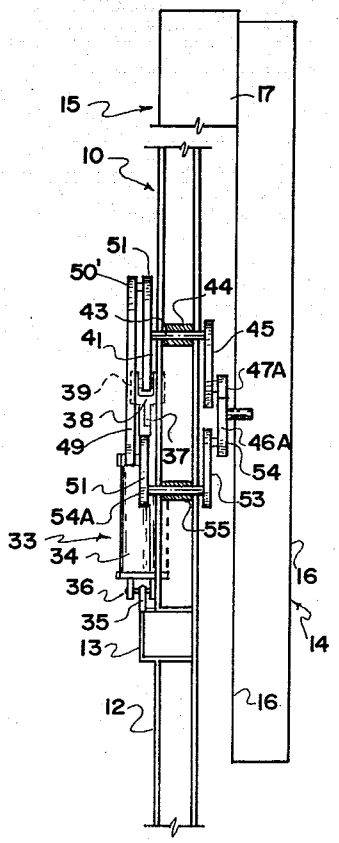
FIG. 2 is an end view of FIG. 1.
Figure 1:
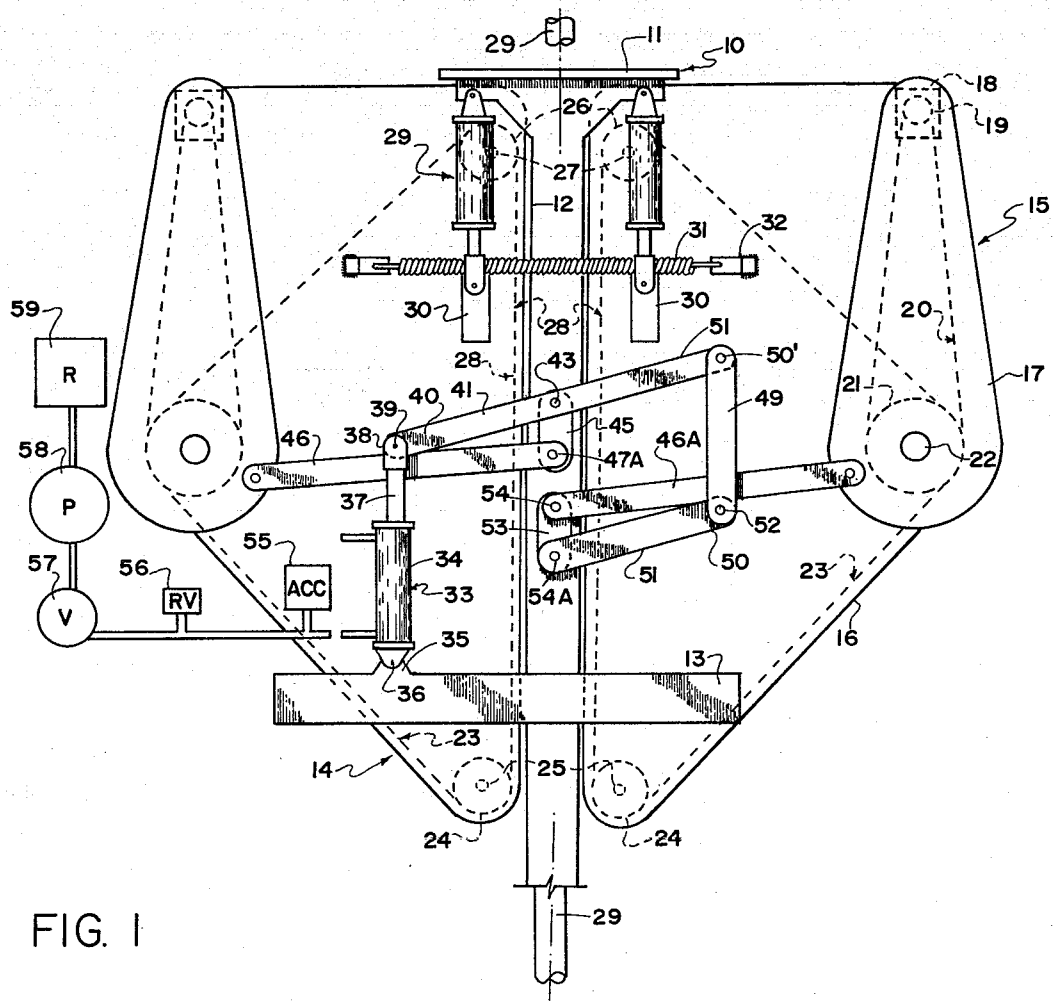
FIG. 1 is a partially schematic front elevation of a tubing injector assembly.

Proceeding therefore to describe the invention in detail, reference should first be made to FIG. 1 in which 10 illustrates general supporting structure including a cross piece 11, a centrally located vertical support 12, and transverse base portion 13.

The tubing injector assembly collectively designated 14 consists of two halves generally designated 15 and as both halves are similar, only one will be described.

The injector half 15 comprises a pair of face plates 16 maintained in spaced apart relationship by means of spacers (not illustrated). A drive chain casing 17 is secured to the outer side of the casing and includes a source of power shown schematically by reference character 18, for driving a drive sprocket 19 mounted within the casing 17. The source of power may be an electric motor, an hydraulic motor or the like.

A drive chain 20 extends around sprocket 19 and around a further sprocket 21 within the casing 17 and this sprocket 21 is secured to a drive shaft 22 extending through casing 17 and through the injector casing 16 being journalled for rotation in the usual way.

Also mounted on drive shaft 22 is a further double drive sprocket (not illustrated) around which an endless chain assembly extends collectively designated 23 and this endless chain assembly extends around a double idler sprocket 24 adjacent the base of casing 16 and journalled upon shaft 25.

It also extends around a double upper idler sprocket 26 in casing 16 mounted upon shaft 27.

Shafts 22, 25 and 27 are journalled for rotation within bearings situated within the casing 16. These drive chains comprise triple row roller chains with the two outer rows of the chain engaging the sprockets 24 and 26 and the double drive sprocket on shaft 22. The dies, 71, hereinafter to be described, are situated between the two outer chains similar to the arrangement illustrated in my Canadian Pat. No. 953,644.

The positioning of the idler sprockets 24 and 27 are such that the drive chain includes vertical runs 28 referred to in at least one of the claims as "tube gripping runs".

With the two halves in the position illustrated relative to the framework 10, these two vertical runs are in opposition one with the other and flexible tubing 29 extends between these runs. Means are provided to move the two halves of the injector casing towards one another so that the vertical runs or tube gripping runs 28 of the chain assemblies 23, grip the tubing and move it upwardly or downwardly depending upon the direction of travel of the chains, it being understood that the sources of power 18 are reversible and also adjustable as to speed.

The injector assembly halves are preferably supported relative to the framework 10 by means of thrust and tension piston and cylinder assemblies 29' suspended from the cross bar 11 and being operatively connected to lugs 30 on the injector casing halves. However this particular portion does not constitute part of the present invention.

Tension springs 31 extend between lugs 32 upon the casing halves and draw the two halves together thus giving a pre-tension to the device and a similar spring (not illustrated) may extend across the two halves adjacent the lower sides thereof.

Means are provided to maintain a preset and relatively constant pressure of the vertical runs 28 of the chain assemblies, upon the tubing 29 extending therebetween, said means taking the form of an hydraulic piston and cylinder assembly collectively designated 33 including a cylinder 34 pivotally connected by one end thereof to a lug 35 by means of pivot pin 36, extending upwardly from a transverse frame member 13. The piston rod 37 of the assembly 33 is pivotally connected by the end 38 thereof and pivot pin 39, to one end 40 of a primary lever 41.

This lever 41 is provided with and secured to a shaft 43 supported for rotation within a bushing 44 and having a fixed link 45 secured to the opposite end of shaft 43 so that the primary lever 41 pivots around the axis of shaft 43 and at the same time pivots fixed link 45 therewith.

A rod or operating link 46 is pivotally secured by one end thereof to a pivot pin 47A in the other end of the fixed link 45 and this rod 46 is operatively connected to a slide block assembly collectively designated 47 by means of pivot pin 48, the function of which will hereinafter be described.

A movable link 49 is pivotally connected by pivot pin 50', to the other end 51 of the primary lever 41 and extends downwardly to be connected to the distal end 50 of a crank arm or connecting link 51 by means of pivot pin 52.

A further fixed link 53 is secured to one end of shaft 54 which runs within bushing 55 and a further operating link or rod 46A is pivotally connected to the distal end of fixed link 53, by means of pivot pin 54A.

The distal end of the operating rod or link 46A is pivotally connected to the slide block assembly 47 of the opposite injector half.

The slide block assemblies 47 each engage against the vertical runs 28 of the two chain assemblies and apply pressure to the tubing 29 extending therebetween and details of the slide block assemblies and the like will be hereinafter described. Suffice to say that by extending the piston and cylinder assembly 33, the rods 46 and 46A will move outwardly thus decreasing the pressure upon tubing 29, and contracting the piston and cylinder assembly 33 will cause the rods 46 and 46A to move inwardly thus applying additional pressure upon the tubing 29.

The hydraulic cylinder assembly 33 operates in a substantially conventional fashion and may include an accumulator 55, a relief valve 56, a control valve 57, an hydraulic pump 58 and a reservoir 59 all of which are conventional.

The assembly permits a predetermined pressure to be applied to the operating rods 46 and 46A varied by means of the adjustable valve 57.

Figure 5:
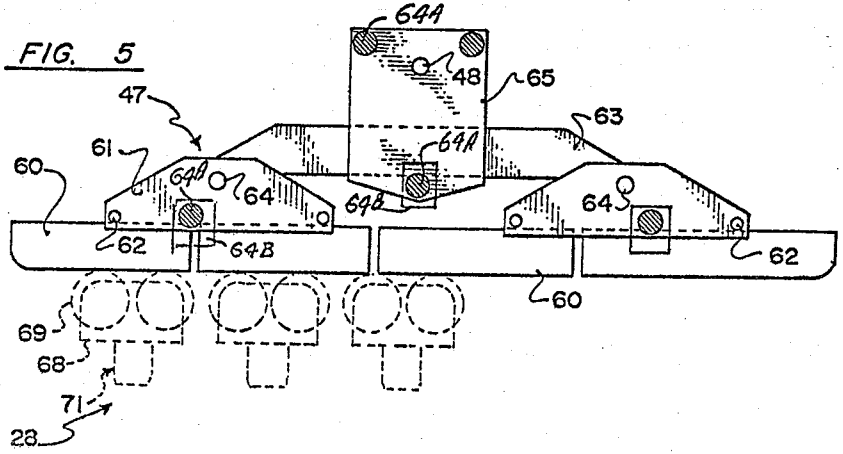
FIG. 5 is a fragmentary partially schematic view of one of the slide block assemblies together with part of the chain assembly.

The slide block assemblies 47 include a plurality of slide blocks 60 which are preferably connected together as shown in FIG. 5 by being pivoted in pairs to the primary centralizing links 61 by means of pivot pins 62.

In turn, the centralizing links 61 are connected together by a further or primary centralizing link 63 by means of pivot pins 64 all of which is shown clearly in FIG. 5. A connector link 65 is secured intermediate the primary link 63 and this in turn is pivoted centrally to the extremity of the operating rod or link 46 or 46A, it being understood that there is a slide block assembly upon each half of the injector.

These centralizing links are freely mounted between centralizer plates 64B in turn supported on pins 64A so that the slide blocks are maintained between the floating plates.

Therefore by moving the rods 46 and 46A towards or away from one another, the slide block assemblies 47 also move towards or away from one another.

The endless chain assemblies in this embodiment, consist of the individual chain links or pairs of plates 68, secured together as by welding and carrying chain rollers 69 journalled on pins 70, therebetween and these rollers engage the slide blocks 60 and run thereover as the chains rotate.

A die collectively designated 71 is welded to the back side edges 72 of the plates 68 at right angles thereto and the dies engage around the tubing 29 and grip same as the chains rotate.

Each die consists of a block having a chain connecting side 72 and a tube engaging side collectively designated 73, the blocks being substantially rectangular when viewed in end elevation. The side 73 is in the form of a recess and comprises, in this embodiment, a central curved segment 74 having a radius adapted to engage around the periphery of the smallest tubing that may be used with these particular dies.

A further pair of segments 75, extend, one upon each side of the ends 76, of the central segment 74 and it will be noted that the diameter or radius of these further segments 75, is greater than the diameter or radius of the curvature of the central segment.

Figure 3:
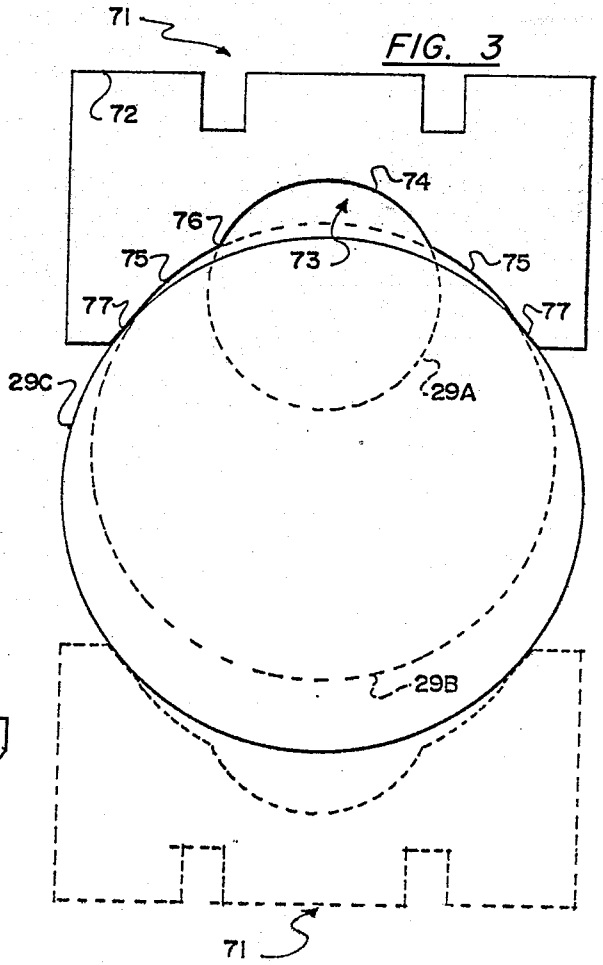
FIG. 3 is an enlarged cross sectional view of one of the friction blocks or dies showing the different diameters that can be accommodated thereby.
Figure 4:
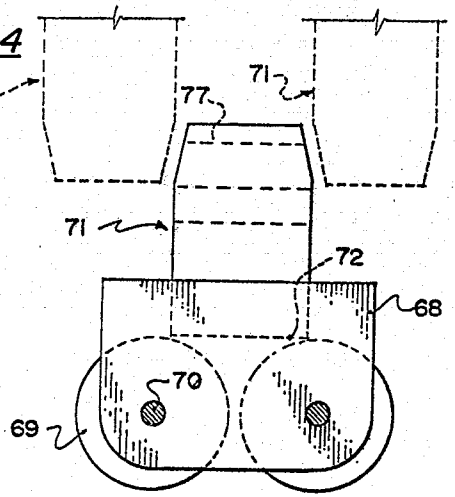
FIG. 4 is an end view of one of the friction blocks or dies attached to a part of the roller chain.

A still further pair of portions 77 extend one from each end of the segments 75 and these portions may either be flat as illustrated in FIG. 3, or may also be slightly curved depending upon design parameters. However if these portions 77 are curved, then the diameter or radius of the curvature thereof is greater than the diameter or radius of the segments 75 and of course the central segments 74.

In FIG. 3, there is shown how three different diameters of tubing, couplings or components may be accommodated by the one set of dies with a tubing 29A being engaged by the central segment 74, a large diameter tubing or component 29B being engaged by the segments 75, and a still further larger tubing for example a coupling 29C being engaged by the portions or segments 77 thus ensuring an adequate and relatively constant grip upon the tubing components or couplings passing through the injector.

Referring back to the hydraulic system and linkage, it will be appreciated that if a preset pressure is applied to the piston and cylinder assembly 33 and the relief valve 56 is adjusted correctly, then if a larger diameter portion engages the injector, the two halves will move apart to permit passage thereby and at the same time maintain the generally same pressure of the dies upon the portion passing through the injector. Once this larger diametered portion has passed, then the halves will return to the original position and grip the tubing at the same preset pressure. Furthermore, the adjustment valve 57 will allow this pressure to be varied depending upon circumstances.

It will therefore be appreciated that the principal features of the device hereinbefore described are firstly that a constant preset and adjustable pressure can be placed upon the tubing being injected or retracted by the assembly, secondly that the assembly will move apart or move together to accommodate changes of diameter of tubing, couplings or components which might be in line, and thirdly the design of the dies will permit accommodation of the different diameters thereby eliminating slippage and preventing the necessity of having to increase pressure to move them through the injector and then release this increased pressure after they have passed.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A tubing injector for well drilling and the like comprising in combination supporting structure, an opposed pair of injector halves supported in said supporting structure, an endless drive chain assembly for each half including tube gripping runs of said chain assemblies, said runs being situated in substantially spaced apart relationship to one another, said runs of chain assemblies engaging the tubing therebetween, means to drive said chain assemblies, means mounting said injector halves upon said supporting structure for independent floating movement towards and away from one another, and adjustable pressure means in said supporting structure to urge said halves towards one another whereby said runs of chain grip said tubing frictionally.

2. The injector according to claim 1 in which said drive chain assemblies include a plurality of tubing gripping dies operatively secured thereto, to engage said tubing between said tube gripping runs.

3. The injector according to claim 1 in which each of said dies includes a chain attaching portion and tube gripping face, said tube gripping face including a plurality of arcuately curved segments, said segments each including a centrally located arcuately curved segment, and at least one further pair of curved segments extending one from each end of said centrally curved segment, the radius of said further curved segments being greater than the radius of said centrally curved segment.

4. The injector according to claim 1 in which said adjustable pressure means includes a slide block assembly for each of said tube gripping runs, said slide block assembly including a plurality of slide blocks in alignment with one another and extending substantially the full length of said runs, means mounting said slide blocks for floating action and pressure equalizing relationship with the tube gripping run engaged thereby, and linkage means operatively connecting the slide block assembly of one half of said tubing injector with the slide block assembly of the other half of said tubing injector, and adjustable fluid operating means operatively connecting said last mentioned means together.

5. The injector according to claim 2 in which said adjustable pressure means includes a slide block assembly for each of said tube gripping runs, said slide block assembly including a plurality of slide blocks in alignment with one another and extending substantially the full length of said runs, means mounting said slide blocks for floating action and pressure equalizing relationship with the tube gripping run engaged thereby, and linkage means operatively connecting the slide block assembly of one half of said tubing injector with the slide block assembly of the other half of said tubing injector, and adjustable fluid operating means operatively connecting said last mentioned means together.

6. The injector according to claim 3 in which said adjustable pressure means includes a slide block assembly for each of said tube gripping runs, said slide block assembly including a plurality of slide blocks in alignment with one another and extending substantially the full length of said runs, means mounting said slide blocks for floating action and pressure equalizing relationship with the tube gripping run engaged thereby, and linkage means operatively connecting the slide block assembly of one half of said tubing injector with the slide block assembly of the other half of said tubing injector, and adjustable fluid operating means operatively connecting said last mentioned means together.

7. The injector according to claim 4 in which said adjustable pressure means includes a slide block assembly for each of said tube gripping runs, said slide block assembly including a plurality of slide blocks in alignment with one another and extending substantially the full length of said runs, means mounting said slide blocks for floating action and pressure equalizing relationship with the tube gripping run engaged thereby, and linkage means operatively connecting the slide block assembly of one half of said tubing injector with the slide block assembly of the other half of said tubing injector, and adjustable fluid operating means operatively connecting said last mentioned means together.

8. The injector according to claim 4 in which said linkage means includes a primary lever operatively connected by one end thereof to said adjustable fluid operating means, a fixed link extending from intermediate the ends of said primary lever, an operating link extending from the distal end of said fixed link to said slide block assembly on one of said tubing injector halves, a movable link pivotally connected by one end thereof to the other end of said primary lever, a connecting link extending from the other end of said movable link, a further fixed link extending from the other end of said connecting link and a further operating link extending from said fixed link, to said slide block assembly on the other of said tubing injector halves, said operating links moving said halves towards and away from one another.

9. The injector according to claim 5 in which said linkage means includes a primary lever operatively connected by one end thereof to said adjustable fluid operating means, a fixed link extending from intermediate the ends of said primary lever, an operating link extending from the distal end of said fixed link to said slide block assembly on one of said tubing injector halves, a movable link pivotally connected by one end thereof to the other end of said primary lever, a connecting link extending from the other end of said movable link, a further fixed link extending from the other end of said connecting link and a further operating link extending from said fixed link, to said slide block assembly on the other of said tubing injector halves, said operating links moving said halves towards and away from one another.

10. The injector according to claim 6 in which said linkage means includes a primary lever operatively connected by one end thereof to said adjustable fluid operating means, a fixed link extending from intermediate the ends of said primary lever, an operating link extending from the distal end of said fixed link to said slide block assembly on one of said tubing injector halves, a movable link pivotally connected by one end thereof to the other end of said primary lever, a connecting link extending from the other end of said movable link a further fixed link extending from the other end of said connecting link and a further operating link extending from said fixed link, to said slide block assembly on the other of said tubing injector halves, said operating links moving said halves towards and away from one another.

11. The injector according to claim 7 in which said linkage means includes a primary lever operatively connected by one end thereof to said adjustable fluid operating means, a fixed link extending from intermediate the ends of said primary lever, an operating link extending from the distal end of said fixed link to said slide block assembly on one of said tubing injector halves, a movable link pivotally connected by one end thereof to the other end of said primary lever, a connecting link extending from the other end of said movable link a further fixed link extending from the other end of said connecting link and a further operating link extending from said fixed link, to said slide block assembly on the other of said tubing injector halves, said operating links moving said halves towards and away from one another.

12. A slide block die for use with a tubing injector, said slide block die including an attaching side and a tube gripping side, said tube gripping side including a centrally recessed curved segment, a first pair of curved segments one upon each side of said centrally curved segment, and a further pair of portions one upon each side of said first pair of curved segments, the radius of curvature of said first pair of curved segments being greater than the radius of curvature of said central curved segment.

13. The slide block die according to claim 12 in which said further pair of portions is also curved, the radius of curvature of said further portions being greater than the radius of curvature of said first pair of curved segments.

* * * * *